US012545492B1

(12) United States Patent
Crescenzi et al.

(10) Patent No.: US 12,545,492 B1
(45) Date of Patent: Feb. 10, 2026

(54) TOUCHLESS EUCHARISTIC DISPENSER

(71) Applicants: Victoria Theresa Crescenzi, Silverdale, WA (US); James Klein, Silverdale, WA (US)

(72) Inventors: Victoria Theresa Crescenzi, Silverdale, WA (US); James Klein, Silverdale, WA (US)

( * ) Notice: Subject to any disclaimer, the term of this patent is extended or adjusted under 35 U.S.C. 154(b) by 0 days.

(21) Appl. No.: 18/217,437

(22) Filed: Jun. 30, 2023

Related U.S. Application Data

(63) Continuation of application No. 17/160,183, filed on Jan. 27, 2021, now abandoned.

(60) Provisional application No. 63/017,575, filed on Apr. 29, 2020.

(51) Int. Cl.
*B65D 83/04* (2006.01)
*A47G 33/00* (2006.01)

(52) U.S. Cl.
CPC ..... *B65D 83/0418* (2013.01); *A47G 33/002* (2013.01)

(58) Field of Classification Search
CPC ..... B65D 83/0418; B65D 2583/0421; B65D 2583/0481; A61J 7/0076; A61J 1/03; A47G 33/002
USPC ..... 221/263, 197, 198, 279, 187, 235, 260, 221/232, 234, 231, 251, 208
See application file for complete search history.

(56) References Cited

U.S. PATENT DOCUMENTS 1,011,272 A * 12/1911 Teeter ..... A45C 1/08 453/48
1,420,377 A * 6/1922 Hopkins ..... G07D 9/002 453/54
1,719,826 A * 7/1929 Glen ..... A47F 1/10 221/274
2,630,245 A * 3/1953 Maier ..... B65D 83/0409 221/265
3,115,992 A * 12/1963 Menolasino ..... B65D 83/0418 221/264
3,300,087 A * 1/1967 Kuypers ..... G01N 35/00 221/273

(Continued)

FOREIGN PATENT DOCUMENTS

DE 3143953 5/1983
DE 3143953 A * 5/1983 ..... B65D 83/0418

(Continued)

*Primary Examiner* — Rakesh Kumar
(74) *Attorney, Agent, or Firm* — Knobbe, Martens, Olson & Bear, LLP

(57) ABSTRACT

An apparatus for housing and delivery eucharistic wafers is provided. The apparatus can include a housing portion that can be configured to house a plurality of wafers that are individually stacked along a vertical axis of the housing. The apparatus includes a platform such that the housing portion is mounted on a top surface of a platform. A slide also rests on the top surface of the platform and is movable along a horizontal axis of the platform. The slide includes a cylindrical-shaped portion that will utilize to push or catch individual wafers from the housing and a narrower handle portion that can be manipulated by a user to direct the slide's movement. The housing portion further includes a front opening is of a sufficient length and height to encourage or limit the passage of a single wafer with each individual, horizontal movement the slider.

21 Claims, 5 Drawing Sheets

(56) References Cited

U.S. PATENT DOCUMENTS 3,768,694 A * 10/1973 Miller ..... B65G 59/105 221/221
3,854,626 A * 12/1974 Krechmar ..... B65D 83/0418 221/273
4,146,151 A * 3/1979 Davis ..... G07D 1/08 221/273
4,216,878 A * 8/1980 Naud ..... A63F 11/0002 453/44
4,413,750 A * 11/1983 Morrone ..... G07D 1/08 273/148 R
4,541,547 A * 9/1985 Miknyocki ..... G07D 1/08 453/39
4,619,376 A * 10/1986 Huss ..... G07D 1/08 221/243
4,792,057 A * 12/1988 Mizer ..... G07D 1/08 221/187
4,830,375 A * 5/1989 Fleming ..... G07D 1/08 453/43
4,928,970 A * 5/1990 Latimer, Jr. ..... A63F 11/0002 453/47
5,100,018 A * 3/1992 Rosati ..... G01J 5/021 374/E1.013
5,148,944 A * 9/1992 Kaufman ..... G07F 11/10 221/268
5,230,440 A * 7/1993 Kurokawa ..... B65D 83/0418 221/232
5,466,897 A * 11/1995 Ross ..... A61B 50/30 221/266
5,702,029 A * 12/1997 Yang ..... G07F 13/10 221/221
6,168,046 B1 * 1/2001 Galesi ..... G07F 11/44 221/133
6,189,742 B1 * 2/2001 Thomson ..... A47G 19/34 222/362
6,299,019 B1 * 10/2001 Leight ..... A61F 15/001 221/265
6,315,170 B1 * 11/2001 Thomson ..... G01F 11/40 222/359
6,431,399 B2 * 8/2002 Gabel ..... B65D 83/0454 221/92
6,763,971 B1 * 7/2004 Tong ..... G07F 11/44 221/151
6,889,869 B2 * 5/2005 Hallin ..... B65D 83/0418 221/270
6,902,163 B2 * 6/2005 Coster ..... A63F 3/0423 273/272
7,424,960 B1 * 9/2008 Vokac ..... G07D 1/08 221/121
7,469,769 B1 * 12/2008 Hmayakyan ..... A61B 7/02 221/176
7,614,478 B2 * 11/2009 Hmayakyan ..... A61B 7/02 221/268
7,673,773 B1 * 3/2010 Walsh ..... A47F 1/123 221/221
7,967,828 B2 * 6/2011 Moore ..... A61B 17/7091 606/86 A
2004/0016766 A1 * 1/2004 Lin ..... G01J 5/021 374/E1.013
2006/0169712 A1 * 8/2006 Yitzchaki ..... G07F 13/10 221/221
2007/0034640 A1 * 2/2007 Casale ..... B43M 15/00 221/232
2007/0090125 A1 * 4/2007 Njaastad ..... A47F 1/085 221/309
2009/0134182 A1 * 5/2009 Walsh ..... G07F 13/10 221/221
2010/0032447 A1 * 2/2010 Yu ..... G01J 5/021 374/209
2016/0001955 A1 * 1/2016 Wang ..... B65D 83/0409 221/268
2019/0241422 A1 * 8/2019 Lee ..... D06F 39/022

FOREIGN PATENT DOCUMENTS

DE 3143953 A1 * 5/1983 ..... B65D 83/04
DE 102016107219 A1 * 9/2017 ..... A61J 7/0481
WO WO-2010060546 A1 * 6/2010 ..... B65B 55/24

* cited by examiner

100

200

TOUCHLESS EUCHARISTIC DISPENSER

REFERENCE TO RELATED APPLICATIONS

This application is a continuation of U.S. patent application Ser. No. 17/160,183, which claims the priority benefit under 35 U.S.C. § 119(e) of U.S. Provisional Application No. 63/017,575, filed Apr. 29, 2020, the entire disclosure of which are incorporated herein by reference.

BACKGROUND

Generally described, individuals can engage in a number of activities or ceremonies related to the exchange of relatively small objects. In the context of religious ceremonies, individuals may exchange relatively small edible objects, such as eucharistic wafers. Eucharistic wafers are considered revered and sacred objects that must be handled in accordance with strict adherence to religious procedures. Often, both the provider and recipient of religious objects, such as eucharistic wafers, must undergo training procedures and are required to strictly follow religious procedures related to the handling, delivery and consumption of eucharistic wafers as part of religious ceremonies or traditions.

In certain scenarios, factors external to religious organizations and religious ceremonies can have a material affect on the practices of the exchange of objects, such as eucharistic wafers. For example, the outbreak of viral or bacterial infections can affect the ability for religious organizations to utilize hand delivery for exchanging objects, such as eucharistic wafers. In other examples, climate conditions, such as dust, heat, etc., may also impact the delivery vessels for housing religious objects and their exchange as part of religious ceremonies.

DETAILED DESCRIPTION

Generally described, aspects of the present application correspond to an apparatus for containing and delivery of objects as part of a person to person exchange. More specifically, aspects of the present application relate to apparatus for housing and delivery eucharistic wafers, generally referred to as wafers. The apparatus can include a housing that can be configured to house a plurality of wafers that are individually stacked along a vertical axis of the housing. The housing includes a cap or top that can be utilized to protect the plurality of wafers from environmental contamination or influence. Additionally, the housing can be configured to host different diameters of wafers.

Illustratively, the apparatus includes a platform such that the housing is mounted on a top surface of a platform. A slide also rests on the top surface of the platform and is movable along a horizontal axis of the platform. The slide includes a cylindrical-shaped portion that will utilize to push or catch individual wafers from the housing and a narrower handle portion that can be manipulated by a user to direct the slide's movement. The top surface of the platform can include a set of guiderails for alignment with the slide and directing horizontal movement of the slide along the horizontal axis. The housing further includes two openings adjacent to a bottom surface of the housing that facilitates interface with the slide. Illustratively, a front opening is of a sufficient width and height to allow the cylindrical portion of the slide to pass through the housing. The height of the front opening is also configured to encourage or limit the passage of a single wafer with each individual, horizontal movement the slide.

The apparatus can further include optional components such as a handle or grip mounted below the platform. The handle or grip can be customized to fit different user scenarios, such as different lengths based on the size or grip position of a user. Additionally, the apparatus can further include an optional cylindrical plate that extends beyond the front platform. The cylindrical plate can be mounted to the bottom of the grip and functions as a catch or safety in the event the wafer is mishandled by a recipient after delivery from movement of the slide.

One or more aspects of the present application will be described with regard to illustrative examples and embodiments. The inclusion of dimensions of wafers for use with embodiments of the apparatus are done solely for purposes of illustration and should not be construed as limiting. Additionally, although embodiments of the present application will be described with regard to possible optional components or combination of components, one skilled in the relevant art will appreciate that optional components may be omitted in accordance with aspects of the present application or additional or alternative combination of components are also within the scope of aspects of the present application.

Figure 1A:
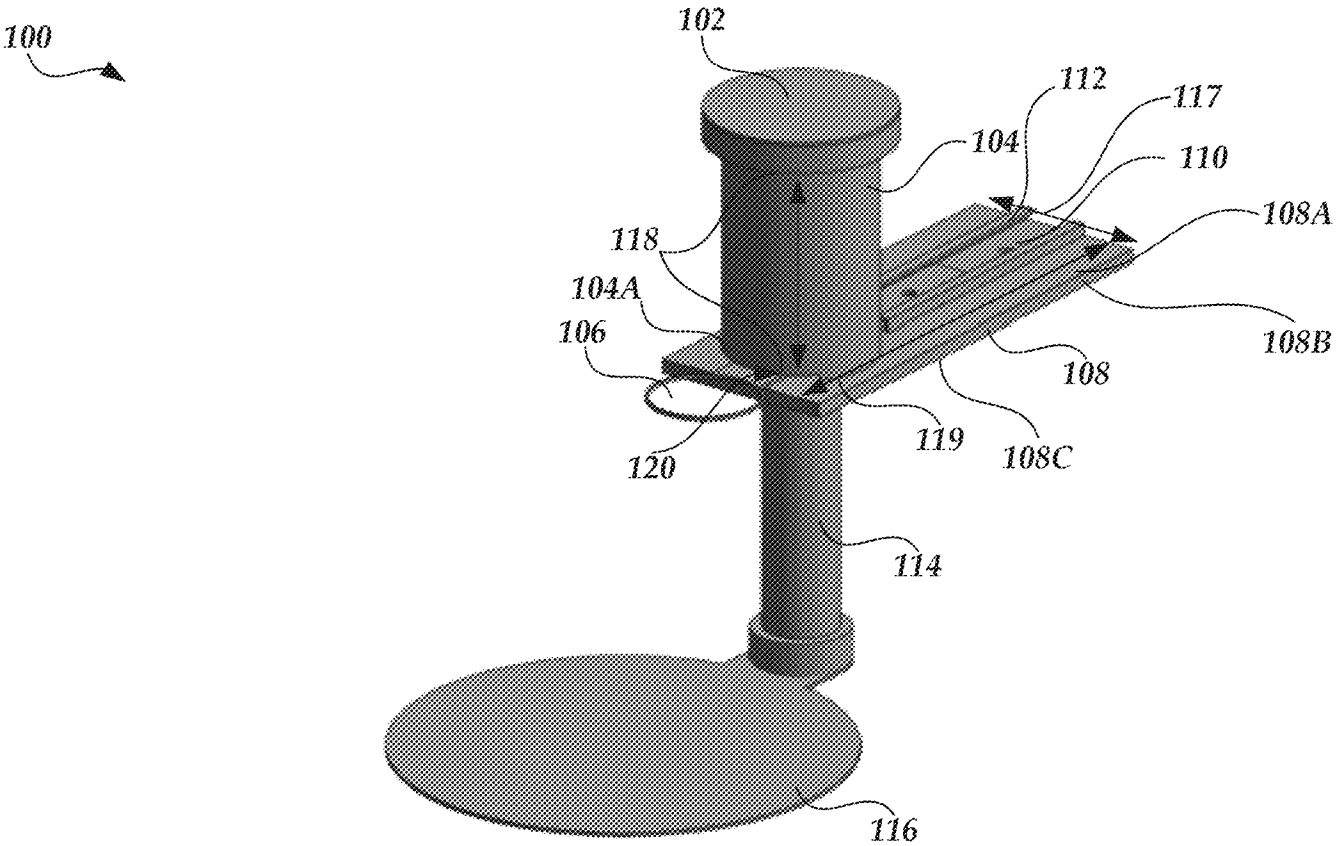
FIG. 1A is a schematic of an embodiment of a touchless eucharistic dispenser according to an aspect of the present application.

FIG. 1A is a schematic of an embodiment of a touchless eucharistic dispenser 100 according to an aspect of the present application. The eucharistic dispenser 100 includes a housing 104 that can be configured to house a plurality of wafers that are individually stacked along a vertical axis of the housing. The housing 104 is illustrative cylindrical in shape having an inner diameter 206 (FIG. 2) to receive a plurality of cylindrical shaped wafers. By way of illustrative example, in one embodiment, the housing 104 may be constructed to have an outer diameter 204 (FIG. 2) of 2 inches and inner diameter 206 (FIG. 2) of 1⅝ inches. The dimension of the housing component may be selected such that the inner diameter will exceed a maximum diameter of wafers (or average diameter) intended to be delivered by the eucharistic dispenser 100. In one embodiment, communion wafer may have a maximum diameter of 1⅜ inches. Additionally, although the inner diameter 206 (FIG. 2) exceeds the maximum diameter of the wafers, the inner diameter 206 (FIG. 2) will illustratively exceed such maximum diameter by a threshold amount, such a range of 1/16 inch to 4/16 inch (¼ inch), so that a plurality of wafers will be stacked substantially vertical to one another. The height 122 of the housing 104 will be configured based on the number of wafers that are vertically arranged. Illustratively, a housing of approximately 3 inches can hold 50-100 wafers.

The eucharistic dispenser 100 also includes a cap 102 or top that engages with the housing 104 and can be utilized to protect the plurality of wafers from environmental contamination or influence. The cap 102 is illustratively removably coupled with the housing 104, such as threads, clips, pressure fitting, and the like. Additionally, the interface between the cap 102 and the housing 104 can include additional sealing mechanisms or intermediate layers to provide protection against additional environmental contamination of the wafers after the wafers have been placed in the housing 104.

The eucharistic dispenser 100 also includes a platform 108 such that the housing 104 is mounted on a top surface 108A of the platform. For example, as illustrated in FIG. 1A, a bottom surface 104A of the housing 104 is mounted flush against the top surface 108A of the platform 108. The platform 108 also includes side surfaces 108B that in some embodiments can be utilized for gripping by a user. The top surface 108A of the platform 108 also hosts two rails 112 that are substantially parallel to a horizontal axis of the platform 108. The two rails 112 are spaced apart to define a channel 110 for accepting the movement of at least a portion of the slide 106. Illustratively, the platform 108 is configured to have a length 119 of 6½ inches, a width 117 of 3½ inches and a thickness/depth of ¼ inch. The dimensions of the platform may be modified in some embodiments such as based the dimensions of slide 106 or to accommodate for increased grip of a user if the platform 108 is utilized as the primary gripping surface. In accordance with this illustrative example, the rails may be 4⅛ inches mounted from an edge of where the housing 104 meets the platform 108.

Figure 1B:
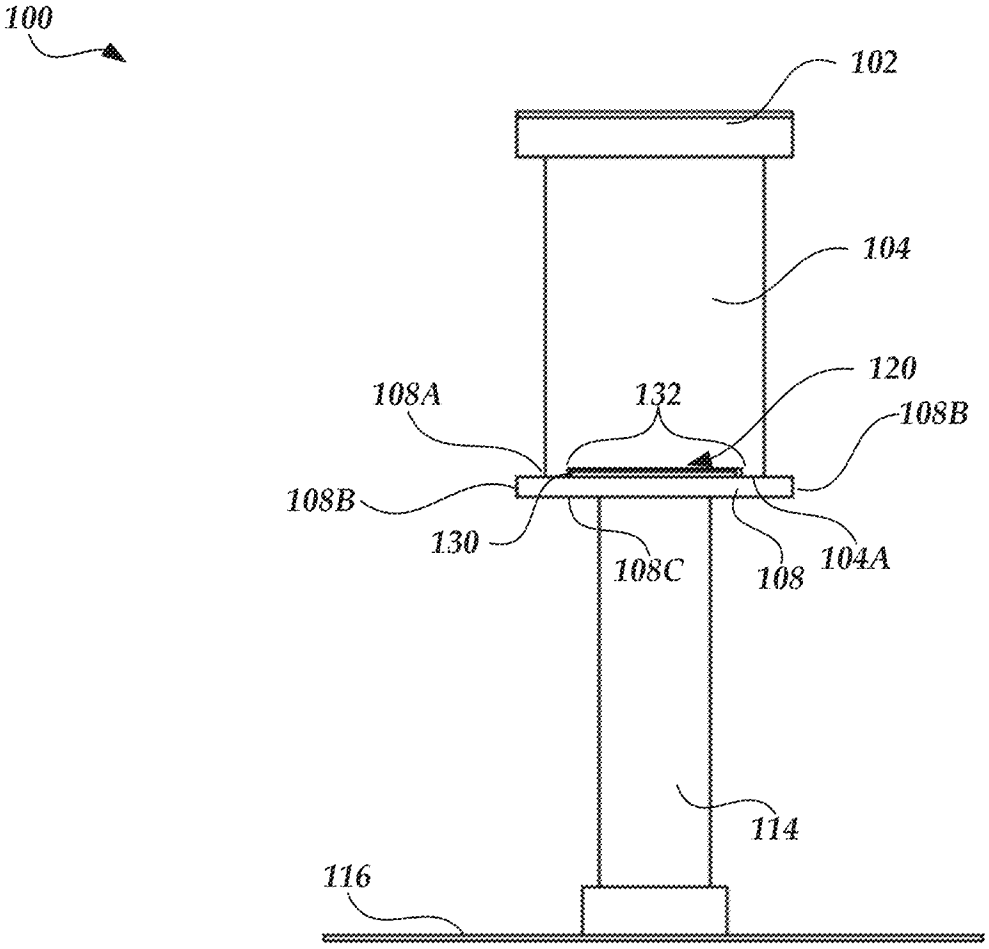
FIG. 1B is a schematic of a front elevation of the touchless eucharistic dispenser of FIG. 1A according to an aspect of the present application.

The housing 104 further includes two openings adjacent to a bottom surface 104A of the housing that facilitates interface with the slide. With reference to FIG. 1B, a front opening 120 is of a sufficient width 132 and height 130 to allow the cylindrical portion of the slide 106 to pass through the housing. The height 130 of the front opening 120 is also configured to encourage or limit the passage of a single wafer with each individual, horizontal movement the slide 106. More specifically, as the slide 106 passes through the opening with a wafer sitting on or within the slide, additional wafers are preventing from passing out the housing by the wall of the housing 104. By way of illustrative example, the width 132 of the front opening 120 can be 1⁹⁄₁₆ inches and the height can be 0.075 inches to achieve this function. However, the dimension of the front opening 120 can be modified to configure to different size wafers. Additionally, in alternative embodiments, the front opening 120 may be adjustable such that at least one dimension of the front opening, such as the height 130, can be modified in a manner to optimize delivery of a single wafer. Still further, the housing 104 can also be configured with a component that could be leveraged to selectively close the front opening 120, such as via a trigger mechanism or a spring-loaded component.

Figure 1C:
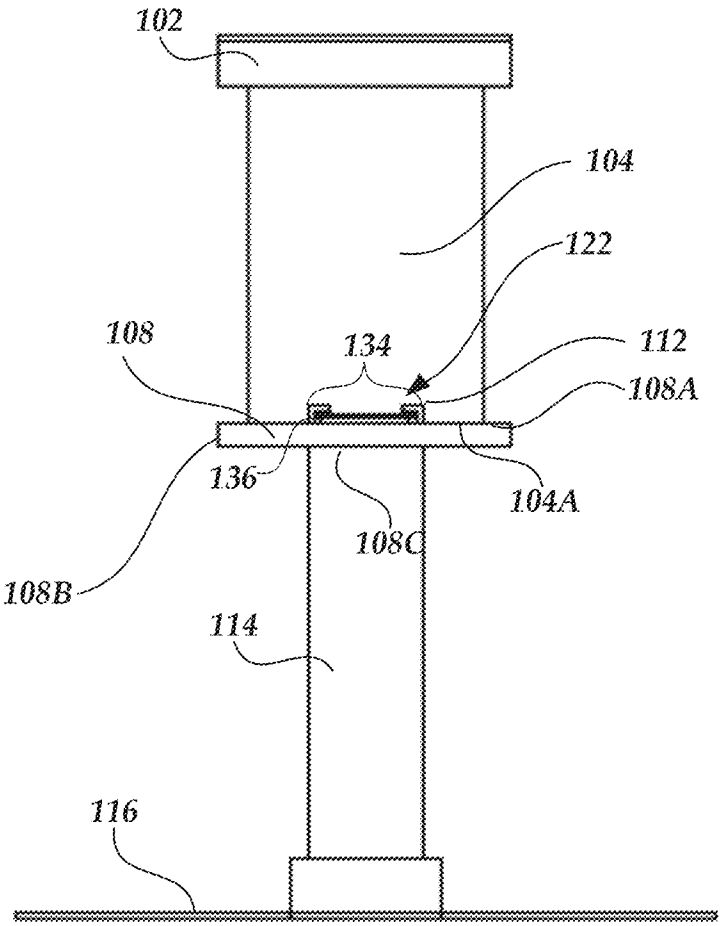
FIG. 1C is a schematic of a back elevation of the touchless eucharistic dispenser of FIG. 1A according to an aspect of the present application.

Turning now to FIG. 1C, the housing 104 also defines or includes a back opening 122 that is of a sufficient width 134 and height 136 to allow the non-cylindrical portion of the slide to pass through the housing. The height 136 of the second or back opening 122 is also configured to encourage or limit the passage the non-cylindrical portion of the slide 106 while preventing the passage of the cylindrical portion of the slide and any wafers. More specifically, as the non-cylindrical portion of slide 106 passes through the back opening 122, the cylindrical portion with a wafer sitting on or within the slide cannot travel out of the back opening 122. This prevent a release of the wafer in the direction of the back opening 122, which could result in the dropping of the wafer. By way of illustrative example, the width 134 of the back opening 122 can be ⅞" inches and the height 136 can be 0.075 inches to achieve this function. However, the dimension of the back opening 122 can be modified to configure to prevent the passage of different size wafers.

Returning to FIG. 1A, the eucharistic dispenser 100 can further include optional components such as a handle or grip 114 mounted below the platform 108, such as along a bottom surface 108C. The handle or grip 114 can be customized to fit different user scenarios, such as different lengths based on the size or grip position of a user. By way of illustrative example, the handle or grip 114 may be 4 inches in length. Additionally, the eucharistic dispenser 100 can further include an optional cylindrical plate 116 that extends beyond the front of the platform 108. The cylindrical plate 116 can be mounted to the bottom of the grip and functions as a catch or safety in the event the wafer is mishandled by a recipient after delivery from movement of the slide 106. In some embodiments, the eucharistic dispenser 100 can be configured with solely the handle or grip 114 and omit the cylindrical plate 116. In other embodiments, both the handle or grip 114 and cylindrical plate 116 may be omitted. In such embodiments, the side surface of the platform 108 may function as a primary gripping area for a user and may be increased or include additional gripping surfaces as required.

Figure 2:
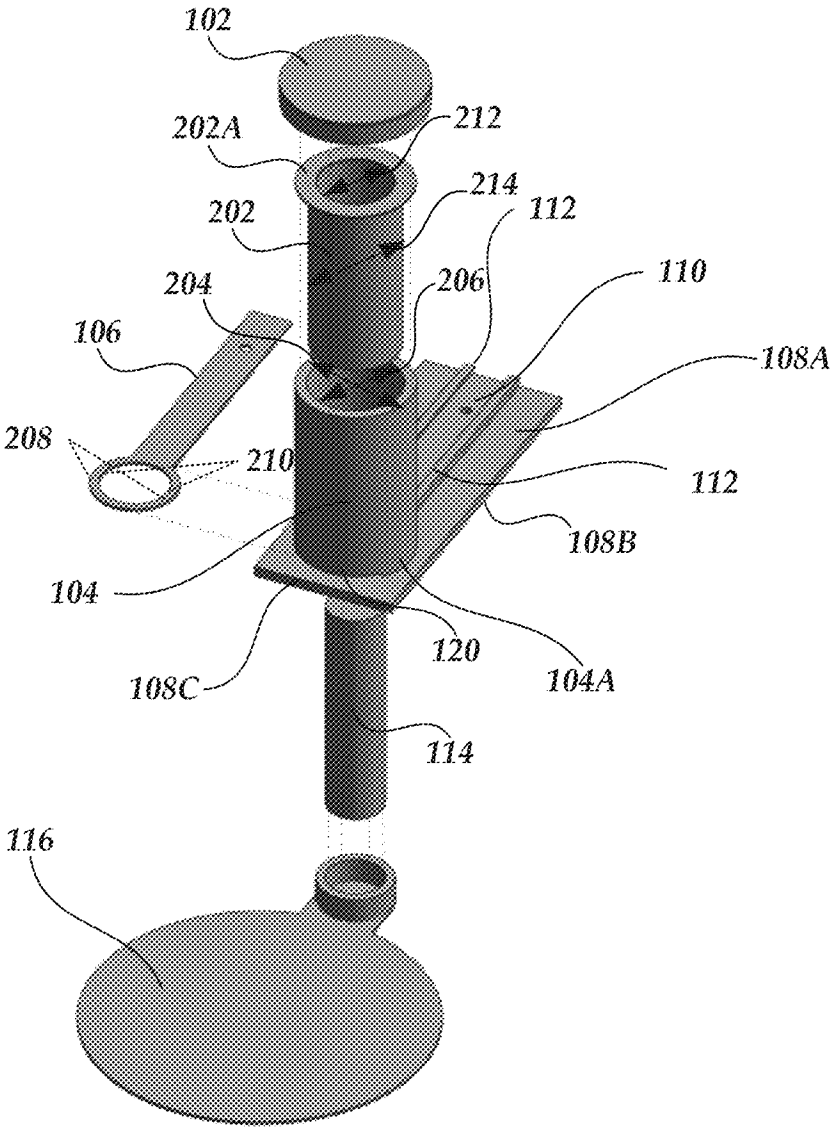
FIG. 2 is a schematic of an embodiment of a touchless eucharistic dispenser according to an aspect of the present application.

Turning now to FIG. 2, an alternative embodiment of a touchless eucharistic dispenser 200 according to an aspect of the present application will be described. As illustrated in FIG. 2, the touchless eucharistic dispenser 200 has a number of common components with the eucharistic dispenser 100 of FIG. 1A, including the platform 108, housing 104, cap 102 handle or grip 114, cylindrical plate 116, etc. and functions in a similar manner to the function of the eucharistic dispenser 100. The touchless eucharistic dispenser 200 is further configured with a sleeve 202 that fits inside of the housing 104 and is utilized to facilitate wafers having a smaller diameter. Illustratively, the sleeve 202 has a top surface 202A that provides a lip or edge that sits on a top surface of the housing 104. The inner diameter 212 of the sleeve 202 is illustratively 1⁵⁄₁₆ inches and the outer diameter 214 is 1⁹⁄₁₆ inches. However, the touchless eucharistic dispenser 200 can include additional sleeve components that have different inner diameters to accommodate for different diameter wafers. As described above with regard to housing 104 (FIG. 1A), although the inner diameter 212 exceeds the maximum diameter of the wafers, the inner diameter 212 of the sleeve 202 will illustratively exceed such maximum diameter by a threshold amount, such a range of ¹⁄₁₆ inch to ⁴⁄₁₆ inch (¼ inch), so that a plurality of wafers will be stacked substantially vertical to one another. In another embodiment, a smaller version of a communion wafer may have a maximum diameter of 1⅛ inches. The height 118 of the housing 104 and sleeve 202 will be configured based on the number of wafers that are vertically arranged. Illustratively, a housing of approximately 3 inches can hold 50-100 wafers.

Figure 3B:
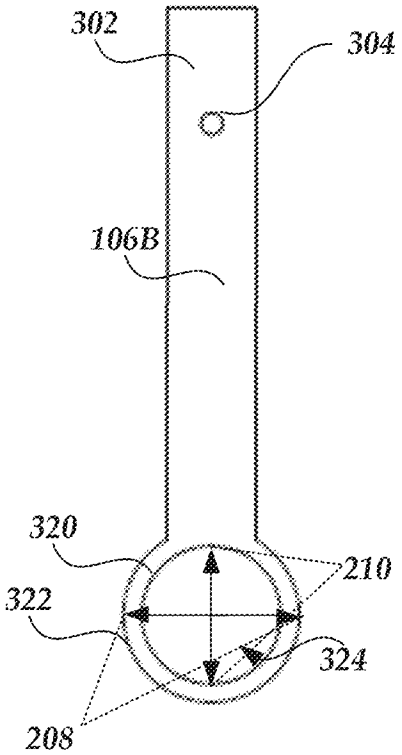
FIG. 3B is a schematic of an embodiment of slide for utilization in a combination with a touchless eucharistic dispenser in accordance with an aspect of the present application.
Figure 3A:
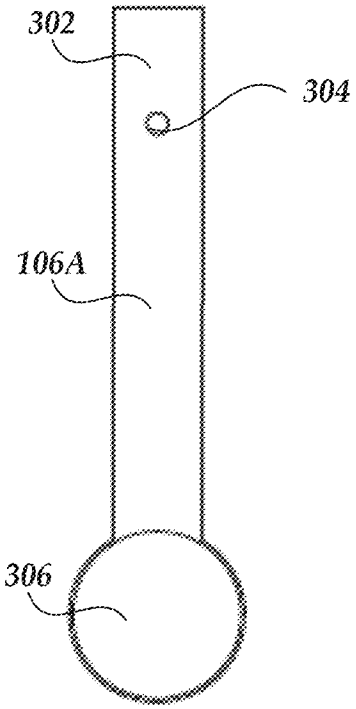
FIG. 3A is a schematic of an embodiment of slide for utilization in a combination with a touchless eucharistic dispenser in accordance with an aspect of the present application.

FIG. 3A is a schematic of an embodiment of slide 106A for utilization in a combination with a touchless eucharistic dispenser, such as touchless eucharistic dispenser 200 (FIG. 2) or eucharistic dispenser 100 (FIG. 1A). The slide 106A includes a non-cylindrical, handle portion 302 that will utilize by the user to cause the slide 106A to travel along the horizontal plane of the platform 108 and through the openings in the housing 104. The handle portion 302 can be of a length and width to allow a user to grip and move the slide 106A. Illustratively, the handle portion 302 can be 4 inches in length and 1 inch in width. The handle portion 302 can also include a fastening hole 304 or divot for secure the slide 106A to the platform 108.

The slide 106A has a solid cylindrical portion 306 that will fit within the housing 104 (FIGS. 1A and 2) and will contact a bottom most wafer in a vertical stack of wafers stored in the housing 104. The diameter of the can exceed the diameter of the wafer, illustratively 1½ inches. The thickness of the slide 106A is illustratively 0.05 inches such that the slide 106A and a single wafer can pass through the front opening of the housing. Accordingly, the thickness of the slide 106A can be adjusted based on either the intended thickness of the wafers, the height of the front opening, or a combination thereof. A top surface of the solid cylindrical portion 306 can include some form tacky material that allows for better contact between the slide 106A and individual wafers.

FIG. 3B is a schematic of an embodiment of an alternative embodiment of a slide 106B for utilization in a combination with a touchless eucharistic dispenser, such as touchless eucharistic dispenser 200 (FIG. 2) or eucharistic dispenser 100 (FIG. 1A). The slide 106B has similar handle portion as illustrated in FIG. 3A for slide 106A. In this embodiment, however, the slide 106B has non-solid cylindrical portion 320 that will fit within the housing 104 (FIGS. 1A and 2) and will contact a bottom most wafer in a vertical stack of wafers stored in the housing 104. The non-solid cylindrical portion 320 is formed of an outer ring 322 having an inner diameter 210 (FIG. 2) and outer diameter 208 (FIG. 2) that creates an opening 324. The inner diameter 210 (FIG. 2) of the outer ring 322 exceeds that maximum diameter of the wafer such that the wafer can sit flush with the slide 106B in the opening 324. The thickness of the slide 106A is illustratively 0.05 inches such that the slide 106B and a single wafer can pass through the front opening of the housing. Accordingly, the thickness of the slide 106B can be adjusted based on either the intended thickness of the wafers, the height of the front opening, or a combination thereof.

In accordance with illustrative embodiments of the present application, one or more embodiments of the eucharistic dispenser 100 or touchless eucharistic dispenser 200 may be utilized to facilitate delivery of individual wafers between individuals. Illustratively, a plurality of wafers are placed in the housing 104 (or sleeve 202) such that the plurality of waters are stacked substantially vertically along a vertical axis of the housing 104. The cap 102 is then placed on the housing and affixed to the housing, such as via screw top, latches, pressure fittings, and the like.

To dispense individual wafers, an individual first moves slider-slide 106, such as slide 106A or slide 106B, in a horizontal direction towards the back of the platform 108 such that the cylindrical portion of the slide 106 is substantially within the housing 104. At this point, a wafer will rest on either on top of the top surface of the solider cylindrical portion of the slide 106A (FIG. 3A) or within the opening in the non-solid cylindrical portion of the slide 106B (FIG. 3B). The user will then manipulate the slider in the opposite direction (horizontally) to direct the slide 106 out of the housing 104, through the front opening 120. As discussed previously, the height of the opening will limit a single wafer to travel on or within the slide 106. The slide 106 can continue the horizontal travel such that wafer and slider will project past the front edge of the platform 108.

A recipient may extend their open hands underneath the touchless eucharistic dispenser 200 or eucharistic dispenser 100. Once the slider is extended beyond the front edge of the platform, the eucharistic dispenser can be tilted to cause a wafer to slide off a solid cylindrical portion of slide 106A. Alternatively, for non-cylindrical slide 106B, the wafer will be pushed passed the edge of the platform 108 via the slide 106A and will utilize gravity to fall into the hands of the recipient without necessity of tilting. The slide 106 can then be reset to repeat the process for a different recipient.

The foregoing disclosure is not intended to limit the present disclosure to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, a person of ordinary skill in the art will recognize that changes may be made in form and detail without departing from the scope of the present disclosure. Thus, the present disclosure is limited only by the claims.

In the foregoing specification, the disclosure has been described with reference to specific embodiments. However, as one skilled in the art will appreciate, various embodiments disclosed herein can be modified or otherwise implemented in various other ways without departing from the spirit and scope of the disclosure. Accordingly, this description is to be considered as illustrative and is for the purpose of teaching those skilled in the art the manner of making and using various embodiments of the disclosed motor assembly. It is to be understood that the forms of disclosure herein shown and described are to be taken as representative embodiments. Equivalent elements, materials, processes or steps may be substituted for those representatively illustrated and described herein. Moreover, certain features of the disclosure may be utilized independently of the use of other features, all as would be apparent to one skilled in the art after having the benefit of this description of the disclosure. Expressions such as "including", "comprising", "incorporating", "consisting of", "have", "is" used to describe and claim the present disclosure are intended to be construed in a non-exclusive manner, namely allowing for items, components or elements not explicitly described also to be present. Reference to the singular is also to be construed to relate to the plural.

Further, various embodiments disclosed herein are to be taken in the illustrative and explanatory sense and should in no way be construed as limiting of the present disclosure. All joinder references (e.g., attached, affixed, coupled, connected, and the like) are only used to aid the reader's understanding of the present disclosure, and may not create limitations, particularly as to the position, orientation, or use of the systems and/or methods disclosed herein. Therefore, joinder references, if any, are to be construed broadly. Moreover, such joinder references do not necessarily infer that two elements are directly connected to each other.

Additionally, all numerical terms, such as, but not limited to, "first", "second", "third", "primary", "secondary", "main" or any other ordinary and/or numerical terms, should also be taken only as identifiers, to assist the reader's understanding of the various elements, embodiments, variations and/or modifications of the present disclosure, and may not create any limitations, particularly as to the order, or preference, of any element, embodiment, variation and/or modification relative to, or over, another element, embodiment, variation and/or modification.

It will also be appreciated that one or more of the elements depicted in the drawings/figures can also be implemented in a more separated or integrated manner, or even removed or rendered as inoperable in certain cases, as is useful in accordance with a particular application. Additionally, any signal hatches in the drawings/figures should be considered only as exemplary, and not limiting, unless otherwise specifically specified.

What is claimed is:

1. An apparatus comprising:

a housing, the housing having a cylindrical shape defined by an outer diameter and an inner diameter, wherein the inner diameter is greater than a maximum diameter of a wafer and wherein the housing has a height to maintain a plurality of wafers arranged within the housing;

a platform having a top surface and bottom surface, wherein the housing is connected to the top surface and defines at least a front opening formed in the housing and adjacent to a top surface of the platform, the front opening having a front opening height and front opening width;

a slide having a cylindrical portion and a non-cylindrical portion, the slide positioned on the platform and configured to move along a horizontal direction relative to the platform, wherein the cylindrical portion has a diameter, wherein the non-cylindrical portion has a width, and wherein the slide has a height;

a handle connected to the bottom surface of the platform; and a plate mounted on a bottom surface of the handle, the plate comprising a first circular portion and a mounting portion extending radially outward from an annular edge of the first circular portion, the mounting portion comprising a second circular portion;

wherein:

the front opening width is greater than the diameter of the cylindrical portion of the slide to allow for passage of the cylindrical portion of the slide into the housing, the front opening height is not greater than a sum of the height of the slide and a height of two or more wafers, the diameter of the cylindrical portion is greater than the width of the non-cylindrical portion;

the width of the non-cylindrical portion is uniform along a length of the non-cylindrical portion;

the first circular portion comprises a diameter exceeding two times the outer diameter of the housing; and the second circular portion is coaxially aligned with the housing.

2. The apparatus of claim 1, wherein the plate is a cylindrical plate.

3. The apparatus of claim 1, wherein the apparatus further includes a sleeve having an outer diameter less than the inner diameter of the housing and an inner sleeve diameter greater than the diameter of the wafer, wherein the sleeve has a height to maintain a plurality of wafers arranged within the housing.

4. The apparatus of claim 1, wherein cylindrical portion of the slide is solid and wherein the diameter of the cylindrical portion of the slide is greater than the diameter of the wafer.

5. The apparatus of claim 1, wherein the cylindrical portion of the slide is non solid and defined by an outer diameter and an inner diameter, wherein the inner diameter of the cylindrical portion is greater than the diameter of the wafer.

6. The apparatus of claim 5, wherein the front opening height is not greater than a sum of the height of the slide and a single wafer.

7. The apparatus of claim 1, wherein the handle is removable.

8. The apparatus of claim 1, wherein the apparatus further includes a cap portion configured to cover a top portion of the housing.

9. The apparatus of claim 1, wherein the platform includes a set of rails substantially parallel to the horizontal direction of the platform and for defining a motion of the slide.

10. The apparatus of claim 1, wherein the maximum wafer diameter corresponds to at least one of one and one eighths inch or one and three eighths inch.

11. The apparatus of claim 1, wherein the non-cylindrical portion extends in a first direction radially outward from an annular edge of the cylindrical portion and the mounting portion extends in a second direction radially outward from the annular edge of the first circular portion.

12. The apparatus of claim 11, wherein the second circular portion extends orthogonally from the second direction.

13. The apparatus of claim 1, wherein the mounting portion is configured to receive the handle.

14. An apparatus comprising:

a housing, the housing having a cylindrical shape defined by an outer diameter and an inner diameter, wherein the inner diameter is greater than a maximum diameter of a wafer and wherein the housing has a height to maintain a plurality of wafers arranged within the housing;

a platform having a top surface and bottom surface, wherein the housing is connected to the top surface and defines at least a front opening formed in the housing and adjacent to a top surface of the platform, the front opening having a front opening height and front opening width;

a slide having a cylindrical portion and a non-cylindrical portion, the slide positioned on the platform and configured to move along a horizontal direction relative to the platform, wherein the cylindrical portion has a diameter and is solid, wherein the non-cylindrical portion has a uniform width, wherein the slide has a height, and wherein the diameter of the cylindrical portion of the slide is greater than the diameter of the wafer and the uniform width of the non-cylindrical portion;

a handle connected to the bottom surface of the platform; and a plate comprising a first circular portion and a mounting portion extending radially outward from an annular edge of the first circular portion, the mounting portion comprising a second circular portion mounted on a bottom surface of the handle;

wherein:

the front opening width is greater than the diameter of the cylindrical portion of the slide to allow for passage of the cylindrical portion of the slide into the housing; and the front opening height is not greater than a sum of the height of the slide and a height of two or more wafers.

15. The apparatus of claim 14, wherein the apparatus further includes a cap portion configured to cover a top portion of the housing.

16. The apparatus of claim 14, wherein the apparatus further includes a sleeve having an outer diameter less than the inner diameter of the housing and an inner sleeve diameter greater than the diameter of the wafer, wherein the sleeve has a height to maintain a plurality of wafers arranged within the housing.

17. The apparatus of claim 14, wherein plate is a cylindrical plate.

18. An apparatus comprising:

a housing, the housing having a cylindrical shape defined by an outer diameter and an inner diameter, wherein the inner diameter is greater than a maximum diameter of a wafer and wherein the housing has a height to maintain a plurality of wafers arranged within the housing;

a platform having a top surface and bottom surface, wherein the housing is connected to the top surface and defines at least a front opening formed in the housing and top surface of the platform, the front opening having a front opening height and front opening width;

a slide having a cylindrical portion and a non-cylindrical portion, the slide positioned on the platform and configured to move along a horizontal direction relative to the platform, wherein the cylindrical portion is non-solid, wherein the cylindrical portion is defined by an outer diameter and an inner diameter, wherein the inner diameter of the non-solid cylindrical portion is greater than the diameter of the wafer, wherein the non-cylindrical portion has a uniform width, wherein the outer diameter of the cylindrical portion is greater than the uniform width of the non-cylindrical portion, and wherein the slide has a height;

a handle coupled to the platform; and a plate mounted on a bottom surface of the handle, the plate comprising a circular portion and a mounting portion extending radially outward from an annular edge of the circular portion, the mounting portion configured to mount on the bottom surface of the handle;

wherein the front opening width is greater than the diameter of the cylindrical portion of the slide to allow for passage of the cylindrical portion of the slide into the housing and wherein the front opening height is not greater than a sum of the height of the slide and a height of a wafer.

19. The apparatus of claim 18, wherein the plate is a cylindrical plate.

20. The apparatus of claim 18, wherein the apparatus further includes a cap portion configured to cover a top portion of the housing.

21. The apparatus of claim 18, wherein the apparatus further includes a sleeve having an outer diameter less than the inner diameter of the housing and an inner sleeve diameter greater than the diameter of the wafer, wherein the sleeve has a height to maintain a plurality of wafers arranged within the housing.

* * * * *